United States Patent [19]

Tanaka et al.

[11] Patent Number: 4,691,767

[45] Date of Patent: Sep. 8, 1987

[54] HEAT EXCHANGER

[75] Inventors: Hiroyoshi Tanaka, Kyoto; Masaaki Adachi, Nara; Yoshiyuki Tsuda, Suita; Shigeo Aoyama, Higashiosaka; Satoshi Tanno; Kaoru Kato, both of Ohtsu, all of Japan

[73] Assignees: Matsushita Electric Industrial Co., Ltd.; Matsushita Refrigeration Company, both of Osaka, Japan

[21] Appl. No.: 772,748

[22] Filed: Sep. 4, 1985

[30] Foreign Application Priority Data

| | | | |
|---|---|---|---|
| Sep. 4, 1984 | [JP] | Japan | 59-185948 |
| Jan. 25, 1985 | [JP] | Japan | 60-12993 |
| Mar. 6, 1985 | [JP] | Japan | 60-44068 |

[51] Int. Cl.[4] ..... F28D 1/04

[52] U.S. Cl. ..... 165/151

[58] Field of Search ..... 165/151

[56] References Cited

U.S. PATENT DOCUMENTS

| | | | |
|---|---|---|---|
| 1,853,315 | 4/1932 | Modine | 165/151 |

FOREIGN PATENT DOCUMENTS

| | | | |
|---|---|---|---|
| 1521499 | 3/1968 | France | 165/151 |
| 82690 | 5/1982 | Japan | 165/151 |
| 192795 | 11/1982 | Japan | 165/151 |

*Primary Examiner*—Albert W. Davis, Jr.
*Assistant Examiner*—Peggy Neils
*Attorney, Agent, or Firm*—Wenderoth, Lind & Ponack

[57] ABSTRACT

A heat exchanger is provided in an air conditioner, refrigerator or the like, and is provided for the indirect transmission and reception of heat between fluids. The heat exchanger comprises a plurality of flat plate fins which are arranged parallel to one another at predetermined intervals so as to allow air stream to flow therebetween, and a plurality of heat transfer tubes passing through the flat plate fins for allowing a fluid to flow therethrough. Each fin is provided with a number of groups of air vents arranged to cross the wake side of the air stream. Each of the air vents is defined by a slat having four sides in which two sides, facing the air stream, are opened and other two sides are provided with leg portions for connecting the slat with the fin. The leg portions are aligned with each other and are inclined with respect to the normal line of the leading edge of the fin. With the above structure, a swirling and a turbulent component of air are induced in the air stream flowing between the fins thereby improving the heat transfer efficiency of the fins.

20 Claims, 18 Drawing Figures

HEAT EXCHANGER

BACKGROUND OF THE INVENTION

The present invention relates to a heat exchanger which is used for air conditioning, refrigeration and the like and which is adapted to perform transmission and reception of heat between fluids.

Conventionally, the heat exchanger of this type has comprised copper tubes connected to each other with U-bent pipes, and aluminum fins so that a heat exchange operation is performed between a cooling medium flowing through the copper tubes and air flowing among the fins.

Recently, this type of heat exchanger has been required to be miniaturized and to have a more improved efficiency, but at present the velocity of air flowing among the fins is forced to be kept at a low speed due to problems such as noise and the like. The thermal resistance of the air around the heat exchanger is extremely high as compared to that of the fluid in the copper tube. Accordingly, to reduce the difference in the thermal resistance between inside and outside the copper tubes, the heat transfer area of the heat exchanger on the outside of the copper tubes, i.e., on the side of the air is made comparatively large when compared to the transfer area inside the tubes. However, the enlargement of the heat transfer surface of the heat exchanger is limited to a certain degree, and therefore, even when the transfer area on the outside of the tubes is made large, the thermal resistance on the inside of the tubes is far higher than that on the outside of the tubes.

Accordingly, attempts have been made to apply suitable processes on the surface of each fin for the reduction of the thermal resistance between the air and the fin.

An example of a prior art heat exchanger is shown in FIGS. 2(*a*) and 2(*b*). The surface of the fin is processed to have air vents, i.e., the fin has interrupted plate passages, so that the thermal resistance of the surface of the fin is lower by 40–50% than that of the ordinary flat plate fin. In FIG. 2(*a*), a numeral 5 designates fin collars, a numeral 6 designates a fin, numerals 7*a* and 7*b* designate bridgelike air vents and a numeral 8 designates the flow direction of air. A cooling medium flows through the copper tubes 4 and the heat of the cooling medium is transmitted from the fin collars 5 fitted about the copper tubes 4*a* and 4*b* to the fin 6 and the bridgelike air vents 7*a* and 7*b*.

At the same time, the air supplied from the direction of the arrow 8 by means of a fan or the like passes among the fins 6 and exchanges heat with the surfaces of the fins of a temperature different from that of the air thereby allowing a heat exchange operation to be performed continuously between the cooling medium and the air. The fin 6 having the louverlike air vents 7*a* and 7*b* can have a surface thermal resistance lower than that of a fin having no such air vents because of the leading edge effect but the following problems have not yet been solved satisfactorily.

PROBLEMS (i) The efficiency of each fin is reduced and the total thermal resistance of the fins is increased since the heat flux transmitted from the downstream side copper tubes 4 is obstructed by the bridgelike air vents 7*a* and 7*b* located right above or below the copper tubes.

(ii) The air streams flowing among the fins 6 are hardly mixed, and thus, the thermal resistance of the surface of each fin is increased since the louverlike air vents 7*a* and 7*b* the fin 6 surfaces are parallel to the air streams and are not so formed as to cause large turbulence to take place in the air streams.

(iii) The dead region produced at the wake of the air with respect to the heat transfer tube 4 becomes large at the center of the air vent 7*a* and 7*b* to thereby reduce the effective surface area of the air vent 7*a* and 7*b* having a low thermal resistance and thus increasing the thermal resistance per unit area.

(iv) The air flow takes place between the heat transfer tubes but it is obstructed by the leg portions of the bridgelike air vents 7*a* and 7*b* so that the pressure loss of the air increases.

SUMMARY OF THE INVENTION

The objects of the present invention are to overcome the above-mentioned problems by employing an improved fin structure with which (i) the heat flux through the fins is not obstructed; (ii) swirling and turbulent streams are generated in the air flow; (iii) the air streams are well mixed; and (iv) the air flows are not obstructed, and thereby reducing both the thermal resistance of the fins and the pressure loss of the air.

The heat exchanger according to the present invention comprises flat plate fins which are arranged parallel to one another at predetermined equal intervals and among which air flows, heat transfer tubes passing through the fins at right angles with respect to the latter and allowing a fluid to pass therethrough and a plurality of louverlike or bridgelike air vents each arranged between adjacent two heat transfer tubes and having its two sides facing the air streams opened, with the line of extension of its sides connected to the surface of each of the flat plate fins making an angle other than the vertical with respect to the leading or trailing edge of the fin.

BRIEF DESCRIPTION OF THE DRAWINGS

FIG. 2(*b*) is a sectional view of the fin taken along a line IIb—IIB shown in FIG. 2(*a*);

FIG. 7(*b*) is a sectional view taken along a line VIIb—VIIb shown in FIG. 7(*a*);

FIG. 7(*c*) is a sectional view taken along a line VIIc—VIIc shown in FIG. 7(*a*);

FIG. 8(*b*) is a cross-sectional view taken along a line XIIIb—XIIIb shown in FIG. 8(*a*);

FIG. 8(*c*) is a cross-sectional view taken along a line XIIIc—XIIIc shown in FIG. 8(*a*);

FIG. 9(*b*) is a sectional view taken along a line IX-b—IXb shown in FIG. 9(*a*); and FIG. 9(*c*) is a sectional view taken along a line IX-c—IXc shown in FIG. 9(*a*).

DETAILED DESCRIPTION OF THE PREFERRED EMBODIMENTS

Figure 1:
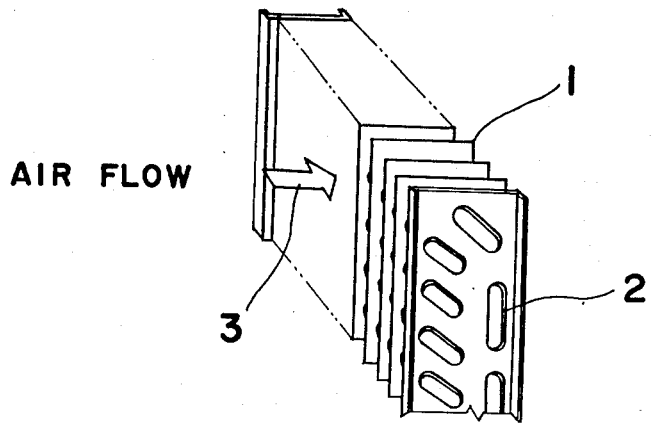
Fig. 1 Prior Art
FIG. 1 is a perspective view of a conventional heat exchanger.
Figure 2A:
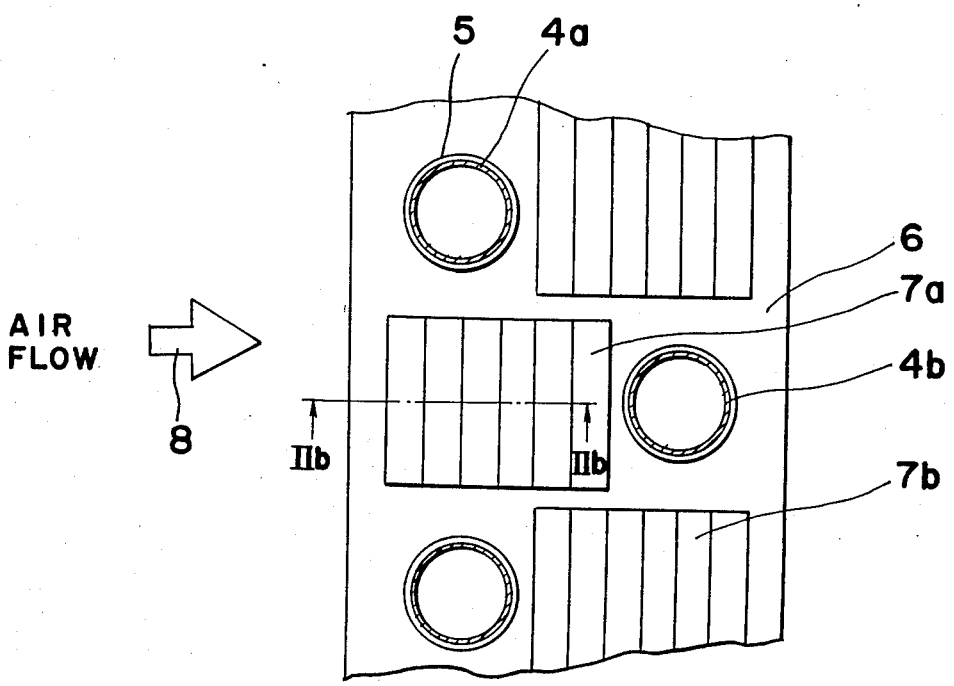
Fig. 2(a) Prior Art
FIG. 2(*a*) is a plan view of a fin of the heat exchanger shown in FIG. 1.
Figure 2B:
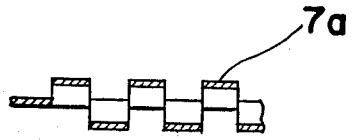
Fig. 2(b) Prior Art
Figure 3:
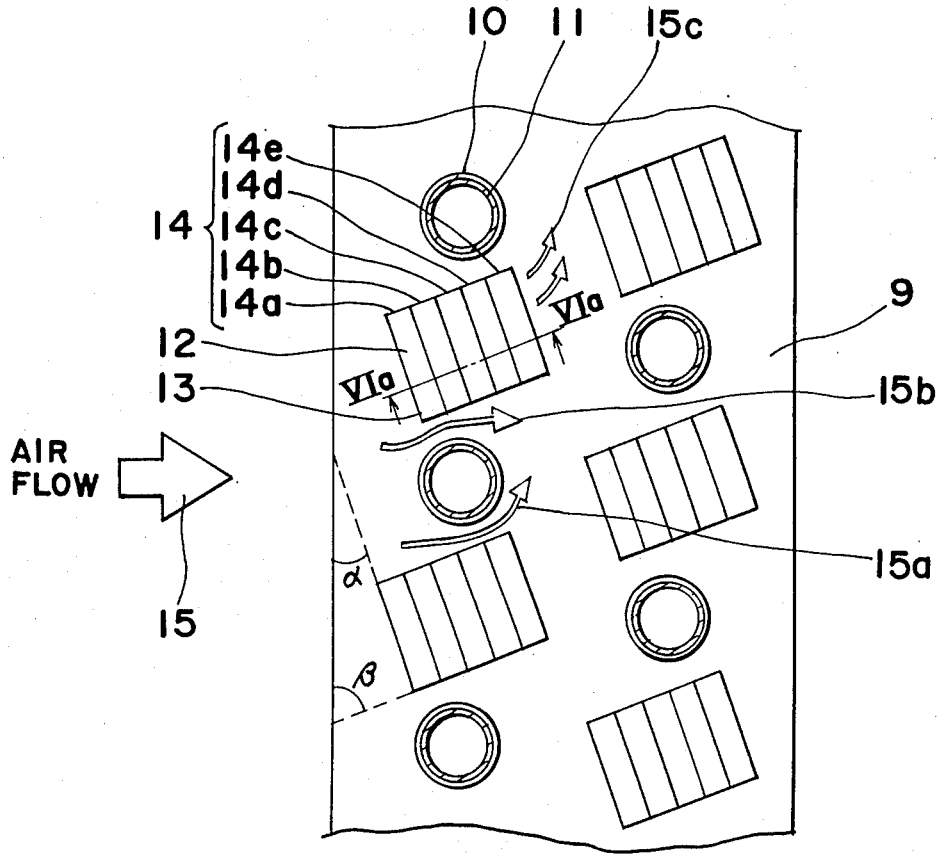
FIG. 3 is a plan view of a fin of a heat exchanger according to a first preferred embodiment of the present invention.
Figure 4:
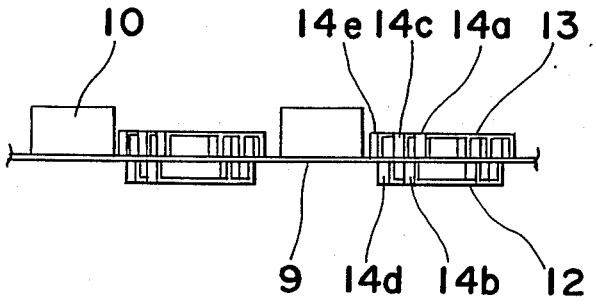
FIG. 4 is a front view of the fin shown in FIG. 3.
Figure 6:
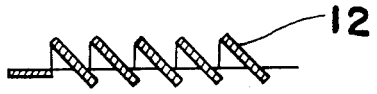
FIGS. 6(*a*), 6(*b*) and 6(*c*) are side sectional views of fins of heat exchangers, respectively, which may be adapted to any one of the first and second embodiments shown in FIGS. 3 or 5.
Figure 6:
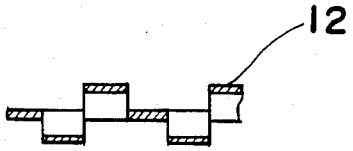
Figure 6:
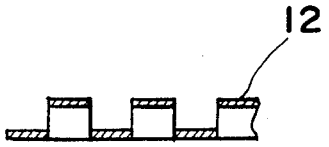

Referring to FIG. 3, a numeral 9 designates one of the flat plate fins arranged parallel to one another at predetermined intervals. Heat transfer tubes 11 are passing through fin collars 10 mounted in the plate fin 9 at predetermined intervals. Air flows toward the fin 9 from the direction of the arrow 15. Among the heat transfer tubes 11, a plurality of louverlike or bridgelike air vents 12 are provided. Each of the air vents 12 is defined by a slat having four sides in which two sides 13, facing the air stream, are opened and the other two sides 14 are provided with leg portions for connecting the slat with the fin. The two sides 13, facing air streams, are parallel to each other and are inclined by an angle of $\alpha$ with respect to the leading edge (air receiving edge) of the plate fin 9. Further, the other two sides 14, where the leg portions are provided are not opened, and are slanted by an angle $\beta$ ($\beta \neq 90°$) with respect to the edge of the fin plate 9. The slants of louverlike air vents 12 may be formed, as shown in FIG. 4, on both upper and lower surfaces of the fin plate 9 alternately so as to project outwardly, or it may also be possible to make them inclined with respect to the surface of the plate fin 9 as shown in FIG. 6(*a*). The air vents 12 may be so modified as shown in FIG. 6(*b*), in which the intermediate portion thereof is not slanted or as shown in FIG. 6(*c*), in which the air vents 12 project from only one surface of the plate fin.

Next, the operation and effects of the heat exchanger of the above structure will be described. As already described, groups of the louverlike air vents 12 are inclined with respect to the normal line of the leading edge of the fin plate and when viewed from the flow direction of air, the louverlike air vents 12 are arranged alternately in different levels.

Accordingly, the air vents 12 located on the downstream side of the air include portions located outside the thermal boundary layer produced by the air vents of the front row on the upstream side of the air, thereby improving efficiencies of such portions. At the same time, fresh air which has not yet been used for the heat exchange with the fluid in the heat transfer tubes is supplied into the openings of the air vents from between the leg portions 14*a* and 14*c*, 14*c* and 14*e* and 14*b* and 14*d*. Thus, the apparent heat transfer efficiency is improved.

Further, since the leg portions 14 are inclined toward the flow direction of the air, the air streams passing around the leg portions 14 of the upstream side air vents 12 are mixed. Accordingly, a favorable heat transfer efficiency can be obtained even at the air vents 12 located behind those of the front row on the upstream side.

In addition, the leg portions 14 of the air vents 12 are inclined by an attack angle with respect to the flow direction of the air. Therefore, an air stream flowing (in the direction of the arrows 15*a*, 15*b*) around each of the heat transfer tubes 11 is induced. Further, each of the leg portions 14 of the air vents 12 is inclined by an angle of $\alpha$ with respect to the leading edge of the fin plate 9. Thus, air flowing in the direction of the arrow 15*c* is generated around the heat transfer tubes 11 when the air passes the leg portions 14 and flows out from the end surfaces of the leg portions 14 of the downstream side air vents. As a result, the dead region produced at the wake of the air with respect to the heat transfer tube 11 is reduced, thereby improving the heat transfer efficiency of the flat plate fin 9. Also, due to the inclination of the leg portions all of the air stream flowing through the air vents is deflected either by the interior walls of the leg portions 14 or the fin collars 10 since all lines perpendicular to the leading edges of the fins intersect either the leg portions 14 or fin collars 10 as is apparent in FIG. 3.

Figure 5:
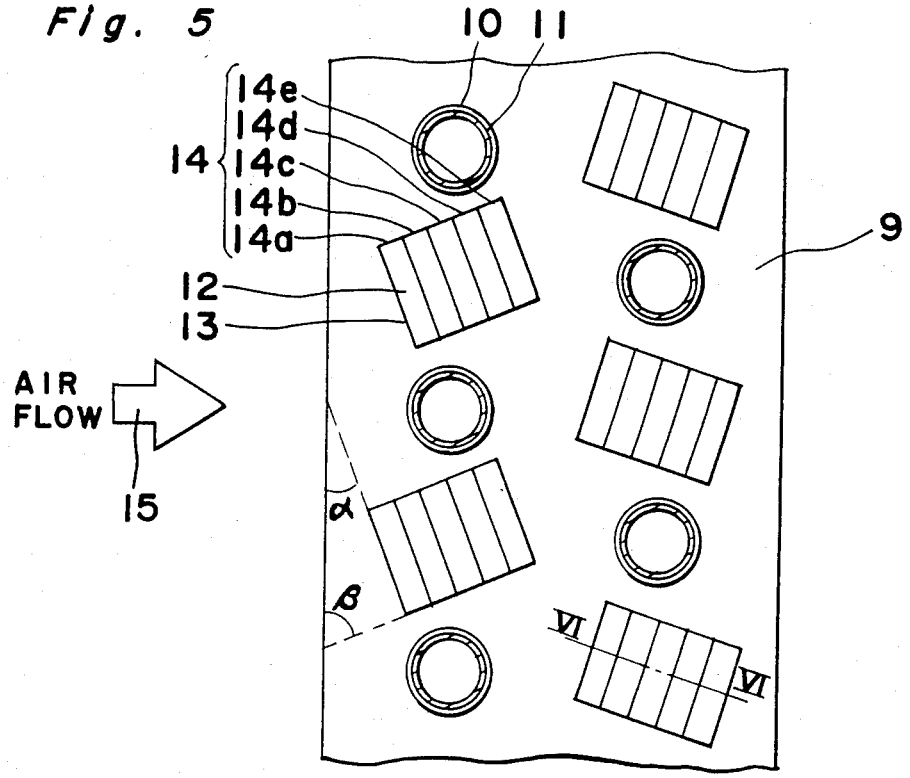
FIG. 5 is a plane view of a fin of a heat exchanger according to a second preferred embodiment of the present invention.

In the first embodiment, the upstream side louver-like or bridgelike air vents and that of the downstream side air vents are arranged in the same direction, but it is possible to arrange them in different directions, such as shown in FIG. 5, showing the second embodiment of the present invention. Further, the leg portions 14 of the air vents 12 may be arranged either parallel or not parallel to the plate fin 9.

As will be clear from the above description, the heat exchanger according to the present invention has such advantages that since the mixing of air streams at the air vents are enhanced, the heat transfer efficiency of the fin plate at the air vents becomes high and the dead region at the wake of the air with respect to the heat transfer tube is reduced. Accordingly, a favorable heat transfer efficiency is obtained throughout the fin, thereby enabling the reduction of the size of the heat exchanger, and at the same time, improving the efficiency of the heat exchanger.

Next, the third embodiment of the present invention will be described in connection with FIGS. 7(*a*), 7(*b*) and 7(*c*).

Figure 7A:
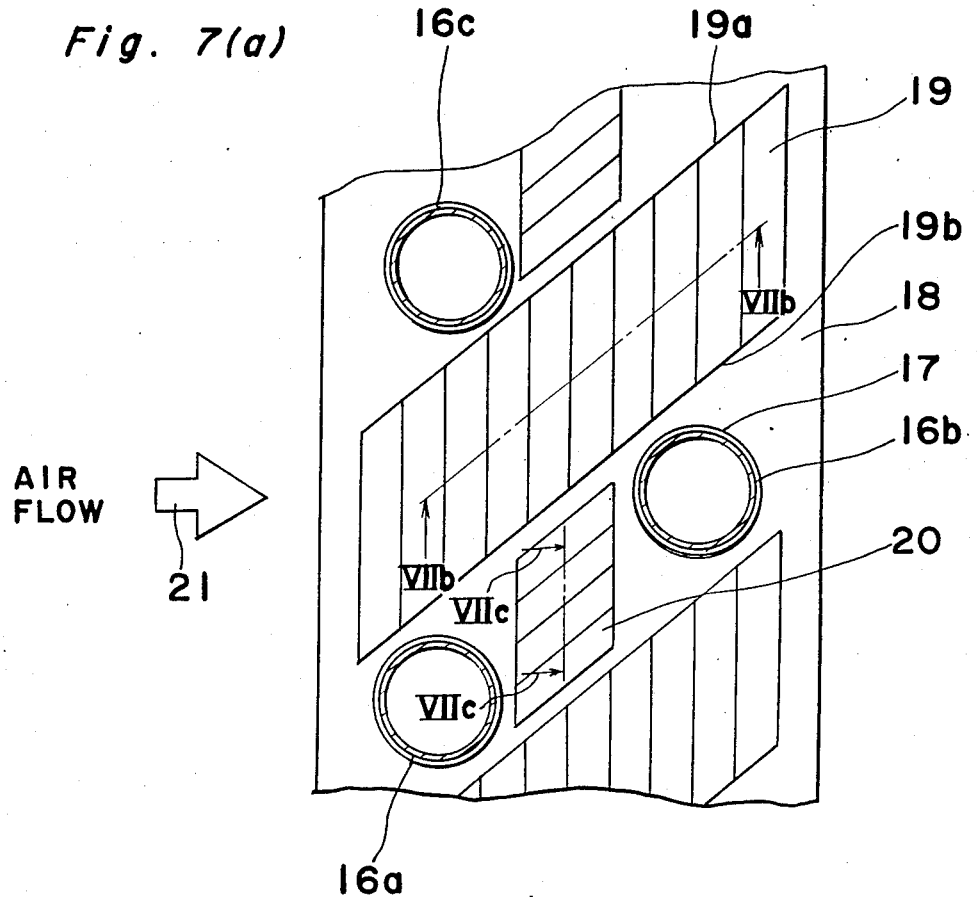
FIG. 7(*a*) is a plan view of a heat exchanger according to a third embodiment of the present invention.
Figure 7B:
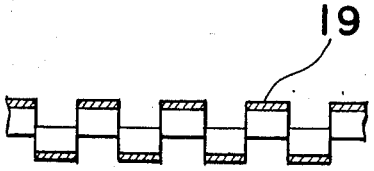
Figure 7C:
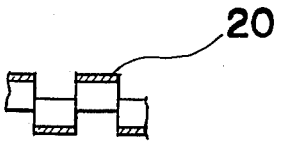

Referring to FIGS. 7(*a*), 7(*b*) and 7(*c*), numerals 16*a*, 16*b* and 16*c* designate copper tubes, numeral 17 designates fin collars burred in the surface of a plate fin 18, and numerals 19 and 20 designate bridgelike air vents, respectively. A cooling medium flows through the copper tubes 16*a*, 16*b* and 16*c*, so that the heat of the cooling medium is transmitted through the copper tubes 16*a*, 16*b* and 16*c*, fin collars 17, fin 18 and to the bridgelike air vents 19 and 20. Accordingly, the air flowing in the direction of the arrow 21 exchanges the heat with the cooling medium indirectly through the fins 18 (including the air vents 19 and 20 and the fin collars 17) when it passes along the fins 18. According to this embodiment, the air vents 19 are formed continuously from the upstream side to the downstream side of the air. Thus, the flow of the air is divided into two parts; one flows through the interior; and the other flows through the outside, of each of the air vents 19. This arrangement may result in turbulence of the air, but takes the advantage of smaller pressure loss of the air. Further, as leg portions 19*a* and 19*b*, through which the air vents 19 are connected to the fin 18, incline with respect to the air streams, an interference phenomenon takes place between the air stream running against the leg portions of each of the air vents 19 and the air stream passing between the leg portions and thereby producing a swirling air stream. This swirling air stream advances forward as it swirls around the upper and lower surface of each of the fins 18 so that the air streams among the fins are mixed violently. Thus, the turbulence of the air due to the slipping of the air streams with respect to the fins and the mixing of the air among the fins as caused by the swirling air stream greatly reduce the surface thermal resistance of each fin. Further, at the portion of the fin 18 between the copper tubes 16*a* and 16*b*, there are provided bridgelike air vents 20 substantially in parallel relationship with the line connecting the centers of the copper tubes 16*a* and 16*b*. The heat flux flows substantially parallel to the lines connecting the centers of the copper tubes 16*a*, 16*b* and 16*c*, but in the third embodiment, the air vents 19 and 20 are always connected to the tubes through their leg portions substantially on the lines so that it hardly obstructs the heat flow. Thus, the lowering of the thermal efficiency of the fin 18 hardly takes place. Further, the leg portions of some of the air vents 20 and 19 are located in the wakes of the air with respect to the copper tubes 16*a* and 16*c* so that the air streams are introduced into the dead region or disturbed by the leg portions. Thus, it is possible to reduce the dead region and to increase the effective heat transfer area of the heat exchanger.

In the third embodiment, the air vents 19 and 20 are defined by bridge-shaped portions projecting up and down from the fin 18, but it is possible to obtain nearly the same effects by forming them louver-shaped portions projecting from only one side of the fin or inclined toward the flow direction of the air.

Next, the fourth embodiment of the present invention will be explained.

Figure 8A:
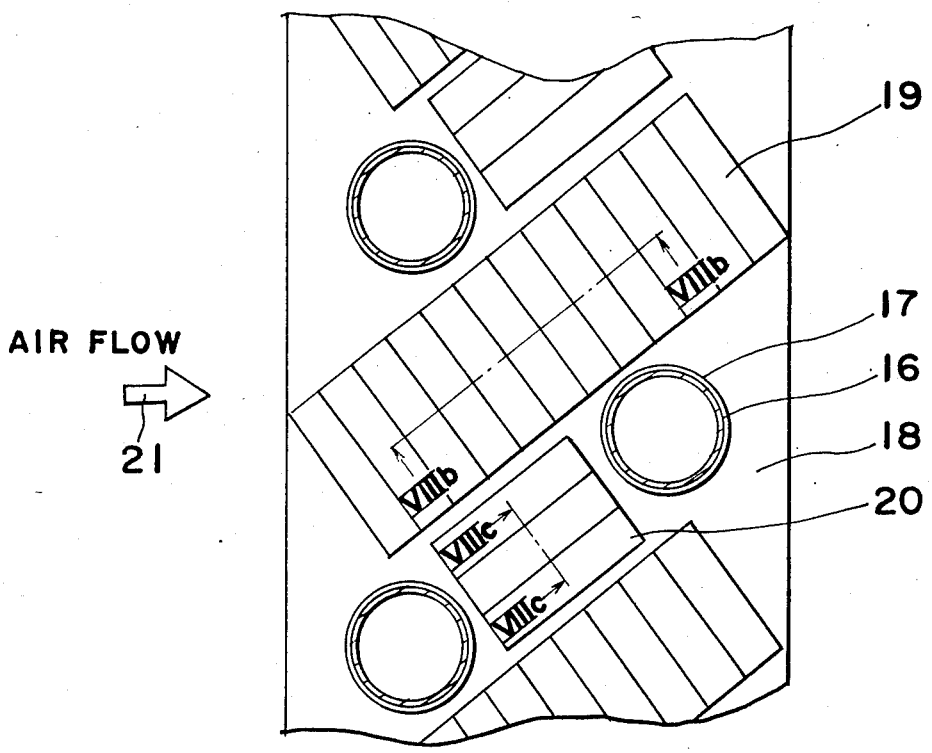
FIG. 8(*a*) is a plan view of a heat exchanger according to a fourth embodiment of the present invention.
Figure 8B:
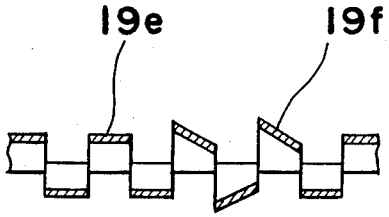
Figure 8C:
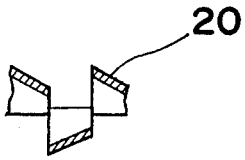

Referring to FIGS. 8(*a*), 8(*b*) and 8(*c*), the structure of this embodiment is similar to the third embodiment described above. However, according to the fourth embodiment, some air vents formed between the copper tubes 16 are inclined, as indicated in FIG. 8(*b*) at 19*f*, with respect to the surface of the fin 18, while the other air vents 19 are made substantially parallel to the surface of the fin 18, as indicated in FIG. 8(*b*) at 19*e*. Further, as indicated in FIG. 8(*c*), the air vents 20 are also inclined with respect to the surface of the fin 18 in the same manner as the air vent 19*f*. Thus, due to the inclination of the air vents 19*f*, 20 with respect to the fin 18, the thermal resistance of the surface of the fin 18 is reduced.

The heat exchanger according to the present invention has a structure such that a plurality of rows of louver- or bridgelike air vents, each defining an opening, are provided, and the leg portions of the air vents are inclined a certain angle with respect to the leading or trailing edge of each fin. Accordingly, it has various advantages in that: (i) the thermal resistance of the surface of the fin is reduced remarkably since turbulent and swirling air streams may be generated along the fins; (ii) the lowering of the efficiency of the fin is reduced remarkably since at least some of the air vents between the heat transfer tubes and between the rows of the air vents themselves are inclined; (iii) the air streams are not obstructed so much by the leg portions of the air vents as in the conventional heat exchanger and it realizes the smaller to increase the pressure loss; and (iv) as the air becomes turbulent, air streams join the wake of air generating with respect to the heat transfer tube so that the dead region is reduced and, at the same time, the effective heat transfer area may be increased.

These effects result in reducing the heat transfer area of the fin so that it is possible to reduce the size of the heat exchanger to a great degree as compared with the conventional heat exchanger and to reduce the manufacturing cost. Further, if the heat exchanger of the present invention has a heat transfer area the same as the conventional one, it must be possible to increase the heat exchange capacity of the heat exchanger so that when the heat exchanger of the present invention is used with a heat pump and the like, it is possible to improve the EER.

Next, the fifth embodiment of the present invention will be described in connection with FIGS. 9(*a*), 9(*b*) and 9(*c*).

Figure 9A:
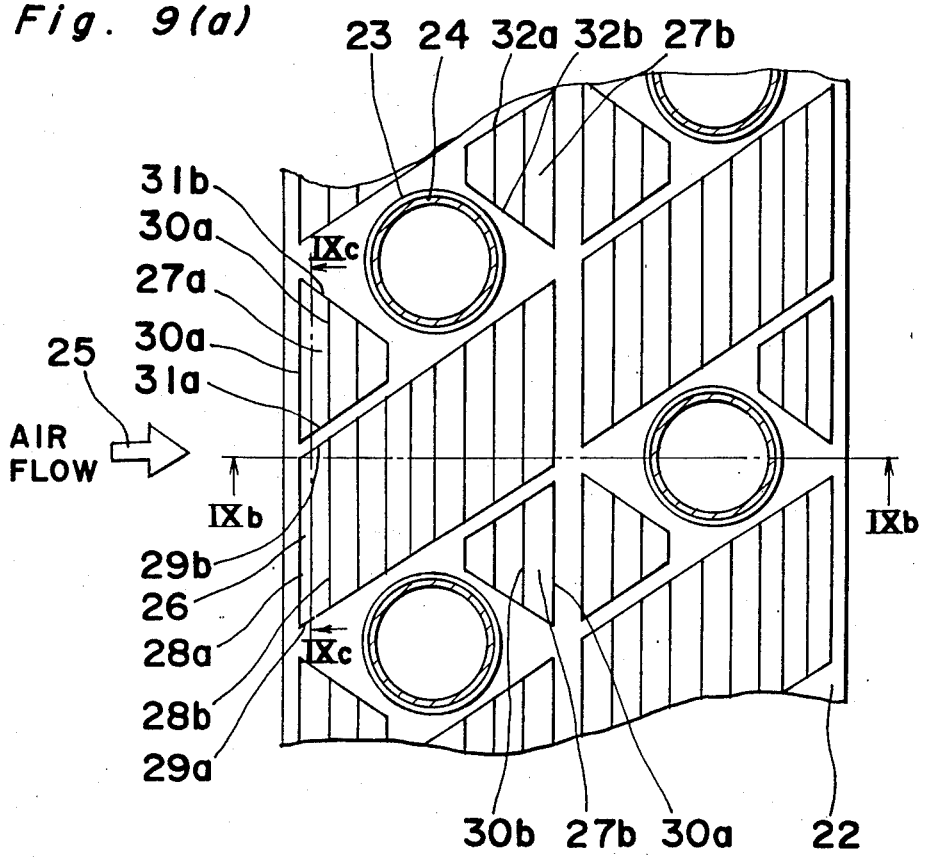
FIG. 9(*a*) is a plan view of a heat exchanger according to a fifth embodiment of the present invention.
Figure 9B:
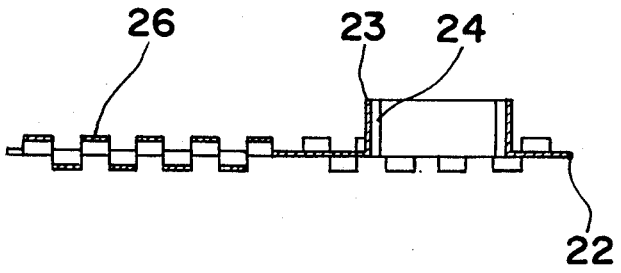
Figure 9C:
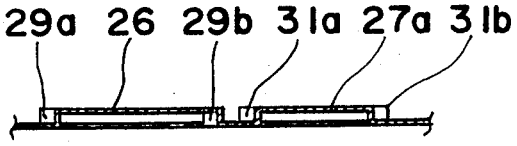

Referring to FIG. 9(*a*), heat transfer tubes 24 are inserted into fin collars 23 burred in a flat plate fin 22 at predetermined intervals. The air flows in the direction of the arrow 25.

On the flat fin plate 22 there is provided a group of air vents 26 each having two sides 28*a* and 28*b* aligned perpendicular to the air flow 25 being opened. The two sides 28*a* and 28*b* are held parallel to the leading edge of the flat plate fin 12. The remaining two sides (leg portions) 29*a* and 29*b* are held parallel to each other, and are inclined with respect to the leading edge of the fin 22. Further, at a portion of the flat plate fin 22 where the group of the air vents 26 is absent, there are provided groups of air vents 27*a* and 27*b*, respectively, with their two sides 30*a* and 30*b* opened and held parallel to the leading edge of the plate fin 22 and with their closed two sides (leg portions) 31*a*, 31*b*, 32*a* and 32*b* being inclined with respect to the leading edge of the fin 22. The leg portions 31*a* and 31*b* of the air vents 27*a* are so tapered that the distance between the leg portions 31*a* and 31*b* becomes narrower towards the downstream side of the air flow in one group, and in the other group, the distance between the leg portions 32*a* and 32*b* becomes greater towards the downstream side of the air flow.

The merits of the heat exchanger according to the fifth embodiment are as follows:

(1) Since the open sides of the bridgelike or louver-like air vents are offset from one another, parts of the downstream side air vents are always held outside the thermal boundary layer generated by the upstream side air vents. Therefore, a favorable heat transfer efficiency is obtained at these portions.

(2) The air vents 26 arranged between the heat transfer tubes are inclined at a predetermined angle with respect to the leading edge of the plate fin so that the direction of all of the air flowing through the air vents differs from that of the air streams flowing outside the air vents, resulting in the slipping of air streams. Also, as can be seen from FIG. 9(*a*), all of the air passing through the air vents is deflected by the interior wall of the leg portions since substantially all straight lines parallel to the direction of air flow (perpendicular to the leading edge of the fin) intersects a leg portion. Thus, a turbulence is produced, and such a turbulence results in destroying the thermal boundary layer thereby improving the heat transfer efficiency of the fin.

(3) Since the closed two sides (leg portions) 29*a* and 29*b* (31*a* and 32*b*) of the air vents are arranged at an angle with respect to the flow directions of the air streams, a secondary air stream having a swirling component is induced at the leg portions of each air vent. This air stream causes the mixing of air which has exchanged its heat at the air vents, with fresh air. Also, since it has a swirling component directed to the wake of the air with respect to the heat transfer tube, the dead region is reduced and the effective heat transfer area is enlarged.

(4) Regarding the air vents 27*a*, an air stream having a swirling component similar to that described above is induced at leg portions 31*a* and 31*b* (i) to act directly on the fin collar 23 of the heat transfer tube thereby improving the heat transfer efficiency thereat, and (ii) to disturb the air stream entering the downstream side air vents to improve the heat transfer efficiency of the fin.

(5) Since the two open sides 30*a* and 30*b* of the air vents are made to become wider in width toward the downstream side, the air stream to the wake of the air with respect to the heat transfer tube is deflected to decrease the dead region. Further, the swirling component of the air stream induced by the leg portions 32*a* and 32*b* is also effective in reducing the dead region and, at the same time, accelerates the generation of turbulence on the downstream of air thereby improving the heat transfer efficiency.

(6) The leg portions of the air vents are arranged uniformly between the heat transfer tubes so that the pressure loss of air flowing between tubes from the upstream to the downstream of the air is equalized. Also, it is possible to obtain a favorable leading edge effect for the equalization of the velocity of air stream between the heat transfer tubes and, thereby obtaining an extremely high heat transfer efficiency at the air vents.

Further, as will be clear from FIG. 9(*b*), the air vents of the above-mentioned groups are so arranged that they are located above and below the flat plate fin 22 alternately. In this case, the two up and down air vents may be formed as a pair, and a space may be provided between the adjacent pairs so that there is provided a portion (on the fin) where no air vent is provided. Such a structure of air vents has the same effect as the above.

The heat exchanger according to the present invention is so constructed that groups of bridgelike or louverlike air vents having openings in the direction of air stream are arranged on the flat plate fin at a portion between the heat transfer tubes. The leg portions of the air vents are inclined by a predetermined angle with respect to the leading edge of the fin. Such a structure has advantages in that since a stream having a swirling component is induced in the air stream flowing between the fins causing the air stream to become turbulent, the air stream mixing effect, turbulence accelerating effect, dead region reducing effect and thermal boundary layer leading edge effect due to equalization of the air stream velocity can be improved, thereby improving the heat transfer efficiency of the fin. Thus, it is possible to reduce the size of the heat exchanger and to improve its heat transfer efficiency.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A heat exchanger comprising:

a plurality of flat plate fins arranged parallel to one another at predetermined intervals so as to allow an air stream to flow therebetween, each fin having a leading edge arranged perpendicularly to the air flow; and a plurality of heat transfer tubes passing through the fins;

each of said fins being provided with a number of groups of successively adjacent first air vents arranged to cross the wake side of the air stream;

each of said first air vents being defined by a first slat having four sides in which two sides, facing the air stream, are opened and the other two sides are provided with leg portions for connecting said first slat with said fin, and said leg portions in each group of first air vents being aligned with each other and being inclined at a same angle with respect to a line along said fin and normal to said leading edge of said fin such that all of the portion of the air stream passing through each group of first air vents is deflected from the direction of flow thereof upon entering said group normal to said leading edge.

2. A heat exchanger as claimed in claim 1, wherein said slat is arranged in a louverlike shape.

3. A heat exchanger as claimed in claim 1, wherein said first slat is arranged in a bridgelike shape.

4. A heat exchanger as claimed in claim 1, in which the two open sides of each of said first air vents facing the air stream is inclined with respect to the leading edge of each of said fins.

5. A heat exchanger as claimed in claim 1, wherein the surfaces of at least some of the first slats are inclined with respect to the surface of each of said fins.

6. A heat exchanger as claimed in claim 1, wherein the surfaces of at least some of the first slats are parallel with respect to the surface of each of said fins.

7. A heat exchanger as claimed in claim 1, wherein the first slats are located alternately on the opposite faces of said fin.

8. A heat exchanger as claimed in claim 1, wherein the first slats are provided with a predetermined interval.

9. A heat exchanger as claimed in claim 1, wherein said first air vents are provided continuously along a space between heat transfer tubes and diagonally with respect to the air flow direction.

10. A heat exchanger as claimed in claim 1, wherein said first air vents are provided intermittently along a space between heat transfer tubes and diagonally with respect to the air flow direction.

11. A heat exchanger as claimed in claim 1, further comprising second air vents located between said first air vents.

12. A heat exchanger as claimed in claim 11, wherein said second air vents have opening parallel to the opening formed in the first air vents.

13. A heat exchanger as claimed in claim 11, wherein said second air vents have opening in an angled relationship with the opening of the first air vents.

14. A heat exchanger as claimed in claim 11, wherein said second air vents are tapered.

15. A heat exchanger as in claim 1, wherein substantially all straight lines along and parallel to any one of said fins and normal to said leading edge intersects at least one of said leg portions of said first air vent.

16. A heat exchanger as in claim 1, wherein all straight lines along and parallel to any one of said fins and perpendicular to said leading edge intersects at least one element in the group of elements consisting of said leg portions and said transfer tubes.

17. A heat exchanger as in claim 1, further comprising a number of groups of successively adjacent second air vents between said groups of first air vents, each of said second air vents including a second slat having four sides including opposite first and second open sides and opposite third and fourth sides, said opposite third and fourth sides respectively including opposite first and second leg portions connecting said second slat with said fin, the first leg portions of each group of second air vents being vents being aligned with each other so as to extend along a first line, the second leg portions of each group of second air vents being aligned with each other and extend along a second line converging toward said first line.

18. A heat exchanger as in claim 1, further comprising a number of second air vents between said groups of first air vents, each of said second air vents including a second slat having four sides including opposite first and second open sides and opposite third and fourth sides, said opposite third and fourth sides respectively including opposite first and second leg portions connecting said second slat with said fin, the first leg portion extending along a first line in a plane of said fin, the second leg portion extending along a second line in said plane converging toward said first line.

19. A heat exchanger as in claim 17, wherein in at least one of said groups of second air vents, said second line converges toward the first line in a direction away from said leading edge and in at least one other of said groups of second air vents, said second line converges toward said first line in a direction toward said leading edge.

20. A heat exchanger as in claim 18, wherein said groups of second air vents includes a plurality of pairs of directly opposing groups of second air vents, each of said pairs including a first group of second air vents in which said second line converges toward said leading edge, and a second group of second air vents disposed between said leading edge and said first group of second air vents in which said second line converges toward said first line in a direction toward said leading edge.

* * * * *